US007143959B2

(12) United States Patent
Smith et al.

(10) Patent No.: US 7,143,959 B2
(45) Date of Patent: Dec. 5, 2006

(54) ACTUATOR WITH STABILIZING RIBS AND IMPROVED FAN SPRAY INSERT

(75) Inventors: Jeremy P. Smith, Loudon, NH (US); Joseph A. Guild, Mijdrecht (NL); Steven M LaSalle, Milford, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 44 days.

(21) Appl. No.: 10/352,269

(22) Filed: Jan. 27, 2003

(65) Prior Publication Data

US 2004/0108331 A1 Jun. 10, 2004

(51) Int. Cl.
*B05B 7/30* (2006.01)

(52) U.S. Cl. ..... 239/354; 239/337

(58) Field of Classification Search ..... 239/337, 239/340, 354

See application file for complete search history.

(56) References Cited

U.S. PATENT DOCUMENTS

| | | | | | |
|---|---|---|---|---|---|
| 3,270,925 | A | | 9/1966 | Obst | 222/394 |
| 3,416,737 | A | * | 12/1968 | Venus, Jr. | 239/579 |
| 3,503,559 | A | * | 3/1970 | Torretta | 239/573 |
| 3,578,220 | A | | 5/1971 | Green | 222/402.13 |
| 3,698,604 | A | | 10/1972 | Nigro | 222/182 |
| 3,731,847 | A | | 5/1973 | Webster | 222/94 |
| 3,817,429 | A | | 6/1974 | Smrt | 222/402.22 |
| 4,401,272 | A | * | 8/1983 | Merton et al. | 239/337 |
| 5,137,180 | A | | 8/1992 | Kieras | 222/108 |
| 5,305,930 | A | | 4/1994 | De Laforcade | 222/402.13 |
| 5,769,325 | A | * | 6/1998 | Jouillat et al. | 239/337 |
| 5,992,765 | A | * | 11/1999 | Smith | 239/337 |
| 6,073,815 | A | | 6/2000 | Ponton | 222/402.21 |

* cited by examiner

*Primary Examiner*—Christopher Kim
(74) *Attorney, Agent, or Firm*—Davis & Bujold, P.L.L.C.

(57) ABSTRACT

An actuator comprising an actuator skirt defining a recess sized to receive a portion of a pedestal of a mounting cap. The actuator having a passageway providing communicating between a valve stem and an insert received within an insert cavity of the actuator. The insert has a discharge orifice and a locking member while the insert cavity has a mating locking member. The mating locking members engage with one another to retain the insert within the insert cavity and allow adjustment of a spray discharge pattern of the insert. The insert cavity has a cavity hub which engages with a leading end of the insert, in an over lapped manner, to form a fluid tight seal therewith and minimize leakage therebetween. An angle rib is attached to a lower surface of the actuator body and abuts against the pedestal, prior to full depression of the actuator, to tilt the actuator slightly upward so that the discharge product does not impinge against the aerosol container.

17 Claims, 12 Drawing Sheets

ACTUATOR WITH STABILIZING RIBS AND IMPROVED FAN SPRAY INSERT

FIELD OF THE INVENTION

The present invention relates to an actuator for a pressurized aerosol valve and, in particular, to an actuator with an improved insert for providing an adjustable fan spray discharge from the actuator. The present invention also relates to at least one stabilizing rib for altering a product discharge direction of the pressurized aerosol as it exits the discharge outlet so that the discharged product does not impinge upon the aerosol container.

BACKGROUND OF THE INVENTION

Pressurized aerosol products typically comprise a container, usually a cylindrical metal can, containing a propellant gas and the product to be dispensed and a valve assembly and actuator for controlling dispensing of the product as an aerosol. One end of the container is closed by a metal dome which is crimped and sealed to the upper side wall of the container and has a central opening for receiving a metal mounting cup which is crimped and sealed into the dome. The mounting cup, in turn, has a central pedestal having a central opening for mounting a valve assembly. The valve assembly provides a controllable flow passage from an inlet formed in a first end of a dip tube, extending downward into the aerosol container and into the product to be dispensed, to an outlet formed in a remote end of a valve stem extending through the central opening in the pedestal and supporting an actuator. The actuator, in turn, generally has a longitudinal passage, extending from the outlet of the valve stem, through the actuator and communicating with a discharge outlet of the actuator, which is shaped to provide the desired discharge spray pattern for the product. When depressed, the actuator moves downward, with respect to the valve assembly and pedestal, and actuates the valve assembly to open the valve so that the product passes through the controllable flow passage of valve assembly and actuator and is dispensed. When the actuator is released, the valve assembly is biased by a spring back to its normally closed position to prevent further dispensing. Such biasing action also, in turn, returns the actuator back to its normal, extended position, with respect to the pedestal, so that the actuator may be again depressed to facilitate further dispensing of product to be dispensed.

One problem which frequently occurs with known actuators is that it is somewhat difficult to adjust the orientation of the product to be dispensed as it is dispensed from the discharge outlet of the actuator. In particular, for a fan spray discharge, it is not easy in most known actuators, to modify the orientation of the fan spray for a particular application, e.g., when spraying upside down or at a particular angle with respect to a surface or object to be sprayed.

Another recurring problem with such pressurized products arises from the general requirement that the actuator be depressed to actuate the valve assembly. This requirement, in turn, generally requires that an inner portion of the actuator be shaped such that when the actuator is depressed and moves downward, the actuator at least partially encloses the upper portion of the pedestal and the valve assembly. The actuator, however, is mounted to the valve assembly only by a tube-like centrally located element, such as a valve stem, of the valve assembly and it is necessary to provide sufficient clearance between the actuator and the pedestal to allow the actuator to move downward and to enclose part of the pedestal. This structural arrangement, in turn, allows the actuator to assume a product discharge angle with respect to a longitudinal axis of the container, the pedestal, and the valve assembly when the actuator is depressed, with the product discharge angle somewhat being dependent upon the angle at which the operator's finger applies pressure on the top of the actuator.

Under desired actuator depression conditions, the product to be dispensed exits the discharge outlet of the actuator at a desired product discharge angle of about 100 degrees or so with respect to the longitudinal axis of the valve assembly so that the product to be dispensed clears the mounting cup and/or the aerosol container and the entire product to be dispensed sprays the desired product, area, item, etc. If, however, undesired actuator depression occurs, the actuator is depressed such that the product to be dispensed exits the discharge outlet of the actuator at a product discharge angle of about 90 degrees or less, so that it is likely that the product to be dispensed will partially impinge on the mounting cup and/or the aerosol container. Besides wasting a portion of the product to be dispensed, the container and possibly the user's hand may become coated with the product, which is generally an undesirable condition.

In this regard, it should be noted that actuators are typically provided with internal "stop ribs" which abut with the top surface of the pedestal to prevent excessive depression of the actuator. The "stop ribs", however, do not alleviate the problem of product impingement on the pedestal as the valve assembly is actuated before the depression limit is reached and the actuator may assume an undesired angle before the depression limit is reached.

SUMMARY OF THE INVENTION

Wherefore, it is an object of the present invention to overcome the above mentioned shortcomings and drawbacks associated with the prior art inserts and actuators.

An object of the present invention is to provide an improved insert, for an actuator, which allows the spray pattern from the insert to be readily modified by an operator.

Another object of the present invention is to provide an improved insert, for an actuator, which provides improved seal between the insert and the actuator to minimize the possibility of any of the product to be discharged from leaking past that seal.

Yet another object of the present invention is to minimize the labor of manufacturing costs and expense and time involved in providing adjustment of the insert within the actuator.

Still another object of the present invention is to provide an actuator for use with a pressurized aerosol product including a container containing a product to be dispensed as an aerosol and a propellant gas and having a pedestal for mounting a valve assembly wherein the actuator is mounted to the valve assembly to dispense product when the valve assembly is actuated by depression of the actuator.

A further object of the present invention is to provide an actuator having a discharge outlet and a passage between the discharge outlet and the valve assembly, an actuator wall extending circumferentially downwards from an actuator body and forming a recess to accommodate at least a portion of the pedestal when the actuator is depressed, and an angle rib attached to a lower surface of the actuator body and the inner surface of the actuator wall and extending inwards in a region adjacent the discharge outlet. The angle rib abuts against an upper surface of the pedestal when the actuator is depressed and before the actuator is depressed sufficiently to actuate the valve assembly and tilts the actuator upward so that the discharge outlet dispenses the product at an upward angle that does not impinge upon the pedestal or any other portion of the container.

A still further object of the present invention is to provide a plurality of angle ribs located in the recess in the region adjacent the discharge outlet, and a lower edge of one or more angle ribs may be shaped and located to contact or abut against the upper surface of the pedestal to limit the depression travel of a portion of the actuator and assisting with preventing damage to the valve assembly by excessive depression.

The actuator may further include one or more stop ribs wherein each stop rib is attached to a lower surface of the actuator body and the inner surface of the actuator wall and extends inwards in a region separated from the discharge outlet to contact an upper surface of the pedestal and thereby to limit the depression travel of the actuator.

The present invention relates to an actuator for an aerosol container, the actuator comprising an actuator body having an actuator skirt defining a recess sized to receive a portion of a pedestal of a mounting cap during depression of the actuator, and the actuator having an actuator passageway facilitating fluid communicating from a valve stem, of an valve assembly, to an insert cavity of the actuator; a fan spray insert received within the insert cavity, and the fan spray insert having a discharge orifice for discharging product from the actuator; and the fan spray insert having a first locking member and the insert cavity having a second mating locking member, and the first and second mating locking members engage with one another, when the fan spray insert is received within the insert cavity, to permanently retain the fan spray insert within the insert cavity while also allow relative movement of the fan spray insert with respect to the insert cavity to adjust a discharge spray pattern orientation of the fan spray insert during use of the actuator.

The present invention relates to an actuator for an aerosol container, the actuator comprising an actuator body having an actuator skirt defining a recess sized to receive a portion of a pedestal of a mounting cap during depression of the actuator, and the actuator having an actuator passageway facilitating fluid communicating from a valve stem, of an valve assembly, to an insert cavity of the actuator; an insert received within the insert cavity, and the insert having a discharge orifice for discharging product from the actuator; and at least one deflector rib supported by the actuator and located to engage with the pedestal each time the actuator is depressed, the at least one deflector rib engaging with the pedestal, prior to the actuator opening the valve assembly, to pivot the actuator backward a sufficiently distance whereby dispensed product from the insert will not impinge against the aerosol container.

The present invention also relates to a method of discharging an aerosol product from an actuator of an aerosol container, the method comprising the steps of providing an actuator body with an actuator skirt defining a recess sized to receive a portion of a pedestal of a mounting cap during depression of the actuator, and the actuator having an actuator passageway facilitating fluid communicating from a valve stem, of an valve assembly, to an insert cavity of the actuator; receiving a fan spray insert within the insert cavity, and providing the fan spray insert with a discharge orifice for discharging the product from the actuator; and providing the fan spray insert with a first locking member and the insert cavity having a second mating locking member, and the first and second mating locking members engage with one another, when the fan spray insert is received within the insert cavity, to permanently retain the fan spray insert within the insert cavity while also allow relative movement of the fan spray insert with respect to the insert cavity to adjust a discharge spray pattern orientation of the fan spray insert during use of the actuator.

DESCRIPTION OF THE DRAWINGS

FIG. 6C is a cross-sectional view of the improved fan spray along section line 6C–6C of FIG. 6A while

DETAILED DESCRIPTION OF THE INVENTION

Figure 1:
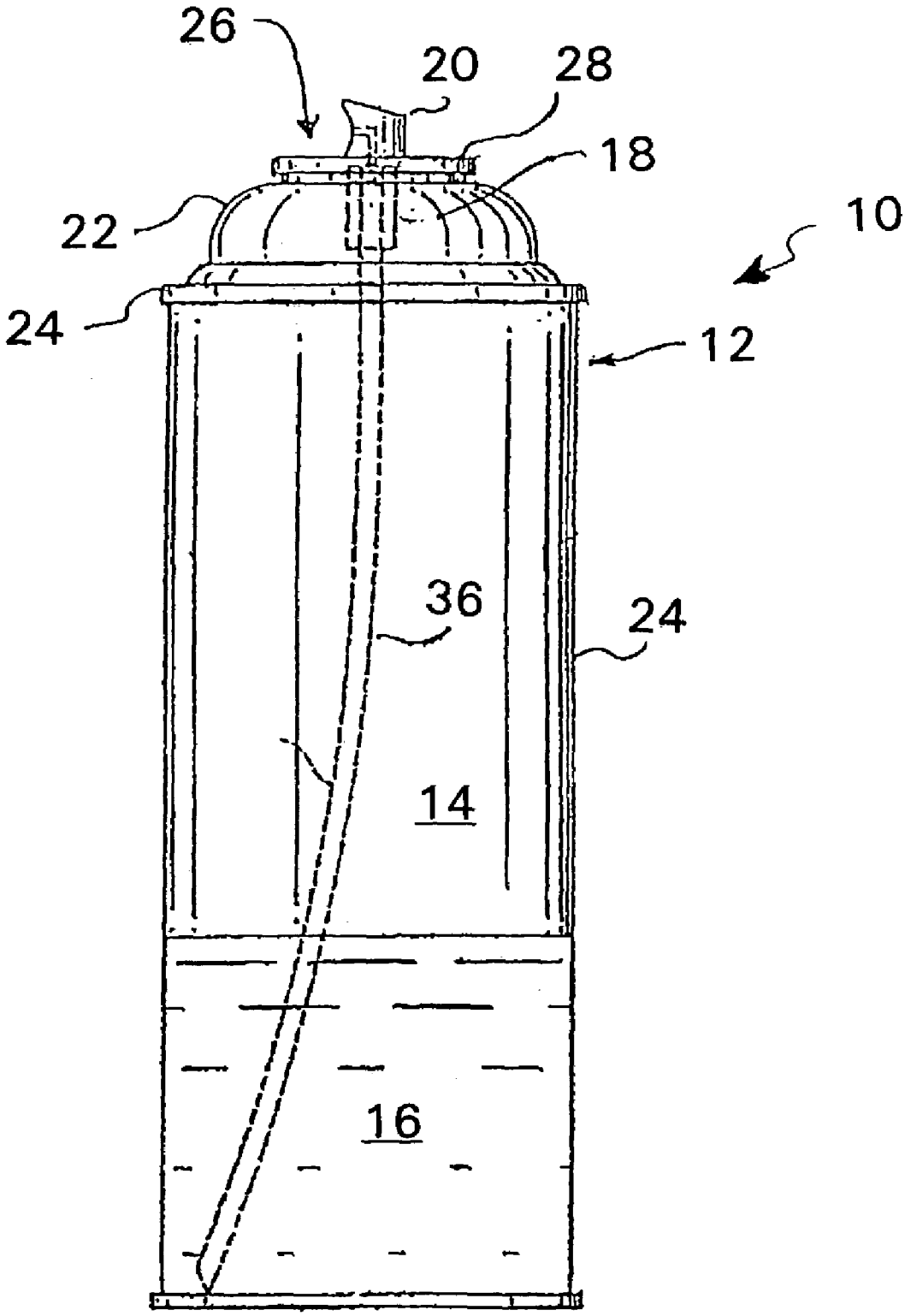
FIG. 1 is a diagrammatic representation of a pressurized aerosol container.
Figure 2:
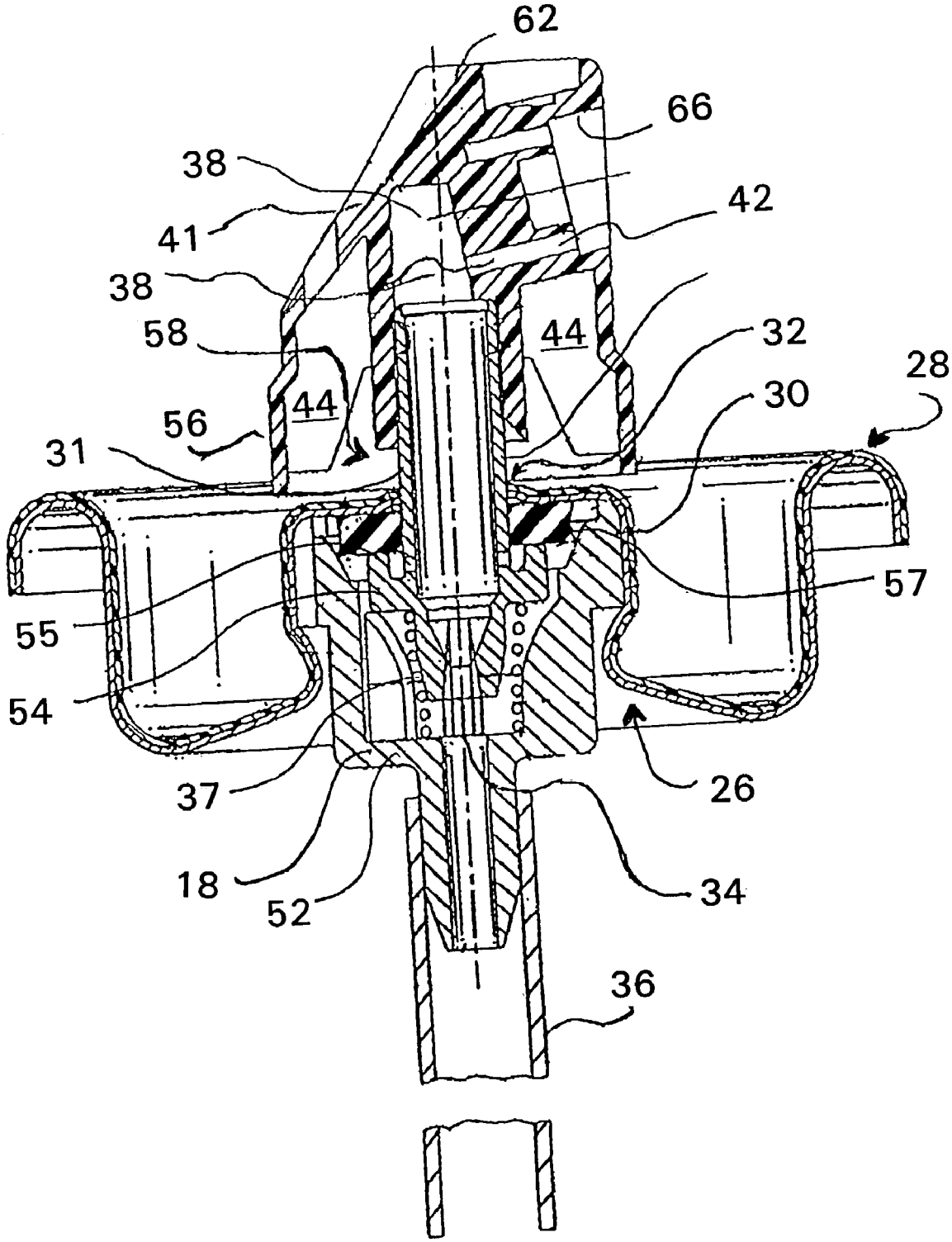
FIG. 2 is a diagrammatic representation of the mounting cup, valve assembly and actuator of a pressurized aerosol product.

Referring to FIGS. 1 and 2, therein is illustrated a pressurized aerosol container or product 10 that is exemplary of those presently in common use. As discussed, an aerosol product 10 typically comprises a container 12, usually a cylindrical metal can, containing pressurized air, pressurized gas or some other propellant 14, a product to be dispensed 16, and a valve assembly 18, including a mounting cup 28, supporting an actuator 20 to facilitate controlled dispensing of the product to be dispensed 16 as an aerosol when desired by an operator.

An upper first end of container 12 is typically closed by a metal dome 22 which is crimped to and seals an upper edge 24 of the container 12. The metal dome 22 has a central opening 26 therein for receiving a metal mounting cup 28 which is crimped to and seals with the perimeter of an upper edge of the metal dome 22 to form a pressurizable container. The mounting cup 28 includes a central pedestal 30 (see FIG. 2) with a central valve opening 32 provided therein for receiving and mounting the valve assembly 18 to the mounting cup 28. The valve assembly 18 provides a controllable flow passage 34 therethrough which extends between an product inlet and a product outlet of the valve assembly 18. A first end of a dip tube 36 is secured to the product inlet of the valve assembly 18 and a remote end of the dip tube 36 extends downward into the product to be dispensed 16 and is located closely adjacent a base of the container 12. A top portion of the valve assembly 18 includes a valve stem 31 supporting the product outlet and the actuator 20 is mounted on the valve stem 31 to facilitate actuation of the valve assembly 18.

The actuator 20, in turn, includes a main actuator body 41 having a central longitudinal actuator passage 38 formed therein which communicates with the product outlet of the valve stem 31. The longitudinal actuator passage 38 extends longitudinally through actuator body 41 and communicates, via a radial actuator passageway 42, with a discharge outlet of the actuator 20 (not shown in this Figure). The discharge outlet 40 (see FIGS. 6–6C) and is typically formed in an insert, e.g., a mechanical break up, which is received in an insert cavity 66 and designed to impart a desired discharge pattern to the product to be dispensed 16 as the product is dispensed from the actuator 20 of the aerosol container. As the product flow from the dip tube 36 through the valve assembly 18 and the actuator 20 and out through the discharge outlet is conventional and well known in the art, a further detail discussion concerning the same is not provided.

When the actuator 20 is depressed, the actuator 20 moves vertically toward and with respect to the valve assembly 18 and the pedestal 30 and actuates, or opens, the valve assembly 18, in a conventional manner, so that the product to be dispensed 16 flows up through the dip tube 36 into the valve housing 52. The product then flows through the valve housing 52 around a periphery of a valve stem 54 and through at least one radial orifice provided in the stem (not separately labeled in the drawings). The product to be dispensed 16 flows along the central passage of the valve stem 31 into the actuator 20. The product to be dispensed 16 finally flows through both the longitudinal and radial actuator passageways 38, 42 and is discharged out through the discharge outlet of a desired insert accommodated with in the insert cavity 66. When the actuator 20 is released, a spring 37 biases the valve stem 54 vertically upward away from a base of the valve housing 52, toward the normally closed position of the valve stem 54, so that an annular lip 55 of the valve stem 54 again abuts and seals against a gasket 57, of the valve assembly 18, to interrupt the flow of the product to be dispensed through the valve housing 52 and prevent further discharge of the product to be dispensed 16 through the valve assembly 18.

As illustrated, when actuator 20 is in its depressed, actuated position (see FIGS. 4A–4B), actuator 20 at least partially surrounds, receives and/or encloses an upper portion of the pedestal 30 of the mounting cup 28. It is to be appreciated that the actuator 20 also may surround, receive and/or enclose at least a portion the upper part of the pedestal 30 when in the actuator 20 is in its normal non-depressed, non-actuated position. For this reason, a cylindrical actuator skirt 56 extends downward from a lower, outer circumferential edge of actuator body 41 and forms an internal recess 58 sufficiently sized to receive and enclose at least the upper portion of the pedestal 30 when the actuator 20 is in the depressed position, and to accommodate the upper portion of the pedestal 30, as necessary, when the actuator 20 is in the non-depressed position. The dimensions of actuator skirt 56 are sufficiently sized to provide clearance between an inwardly facing surface of the actuator 20 and an outwardly facing surface of the pedestal 30 of the mounting cup 28 so as to allow uninhibited vertical relative up and down movement of the actuator 20 with respect to the pedestal 30.

Figure 3:
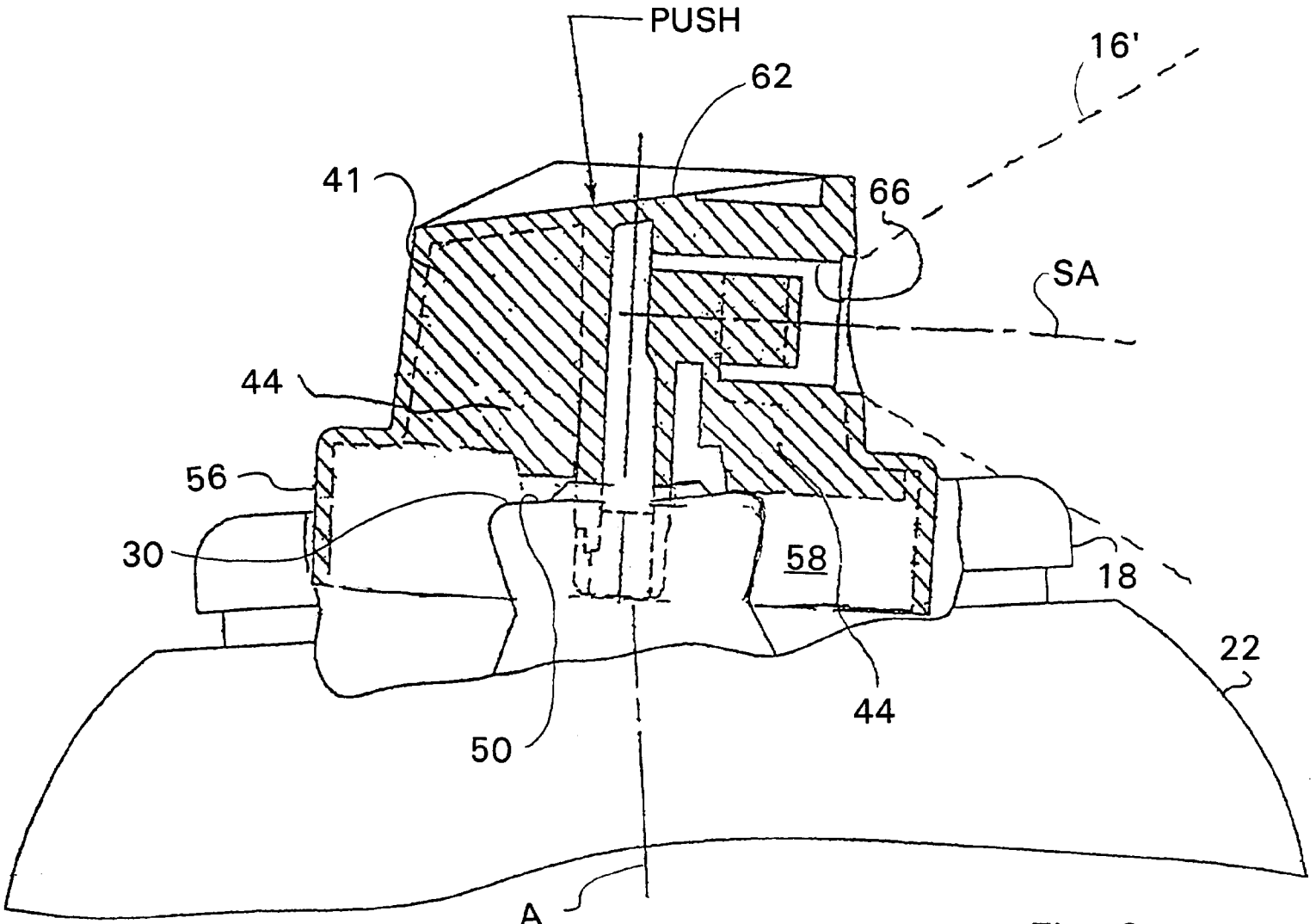
Fig. 3 Prior Art
FIG. 3 is a diagrammatic illustration of the dispensing angle problem of actuators of the prior art.

As further illustrated if FIG. 3, the actuator 20 is typically provided with a plurality of internal stop ribs 44 attached to a lower surface of the actuator body 41 and extending into the recess 58. The stop ribs 44 extend axially downwardly by a distance sufficient to contact or abut against the top surface of the pedestal 30 and operate to limit the downward depression travel of the actuator 20 so as to prevent excessive or over depression of the actuator 20 and possible consequent damage to valve assembly 18. For this reason, stop ribs 44 extend axially downward from the actuator body 41 by a distance that is selected to abut with or against the top surface of the pedestal 30 only after a desired depression sufficient to completely open the valve assembly of the actuator 20 is reached but prior to excessive depression of the valve stem 54 occurring. The allowable vertical travel of actuator 20 is generally selected so that valve assembly 18 is fully actuated and opened before the depression limit, determined by contact of stop ribs 44 with the top surface of the pedestal 30, is reached. During typically use of the actuator 20, the actuator 20 is depressed a sufficient distance to completely open the valve assembly so that the stop ribs 44 are located closely adjacent to the top surface of the pedestal 30 but do not abut or contact the same. The stop ribs 44 only prevent excess depression of the actuator 20.

As illustrated in FIG. 3, the actuator 20 structure of the prior art allows the actuator 20 to assume a product discharge angle DA with respect to the longitudinal axis A of the aerosol container 12, the pedestal 30 and/or the valve assembly 18 when actuator 20 is depressed. It is to be appreciated that the product discharge angle DA assumed by actuator 20 is at least partially dependent upon the angle at which the operator's finger applies pressure to the top surface of the actuator 20. The actuator 20 and the discharge outlet 40 may thereby assume a substantially normal or slightly acute product discharge angle DA, as illustrated in FIG. 3, rather than a desired obtuse product discharge angle DA, such that the spray pattern of the dispensed product 16' may partially impinge on the mounting cup 28. The impinging of the discharge spray of the dispensed product 16' on the mounting cup 28, or upon any other portion of the aerosol container, thereby results in an interruption of the discharged spray pattern and wastes a portion of the dispensed product 16'. Further, the container 12 and possibly the user's hand may become coated with the dispensed product 16', which is generally an undesirable result. It must be noted that the stop ribs 44 of the prior art do not alleviate this problem as the valve assembly 18 is not excessively actuated, upon most depressions by an operator, so that the stop ribs 44 are located closely adjacent to the top surface of the pedestal 30 but are spaced therefrom and do not abut or contact the pedestal 30.

Figure 4A:
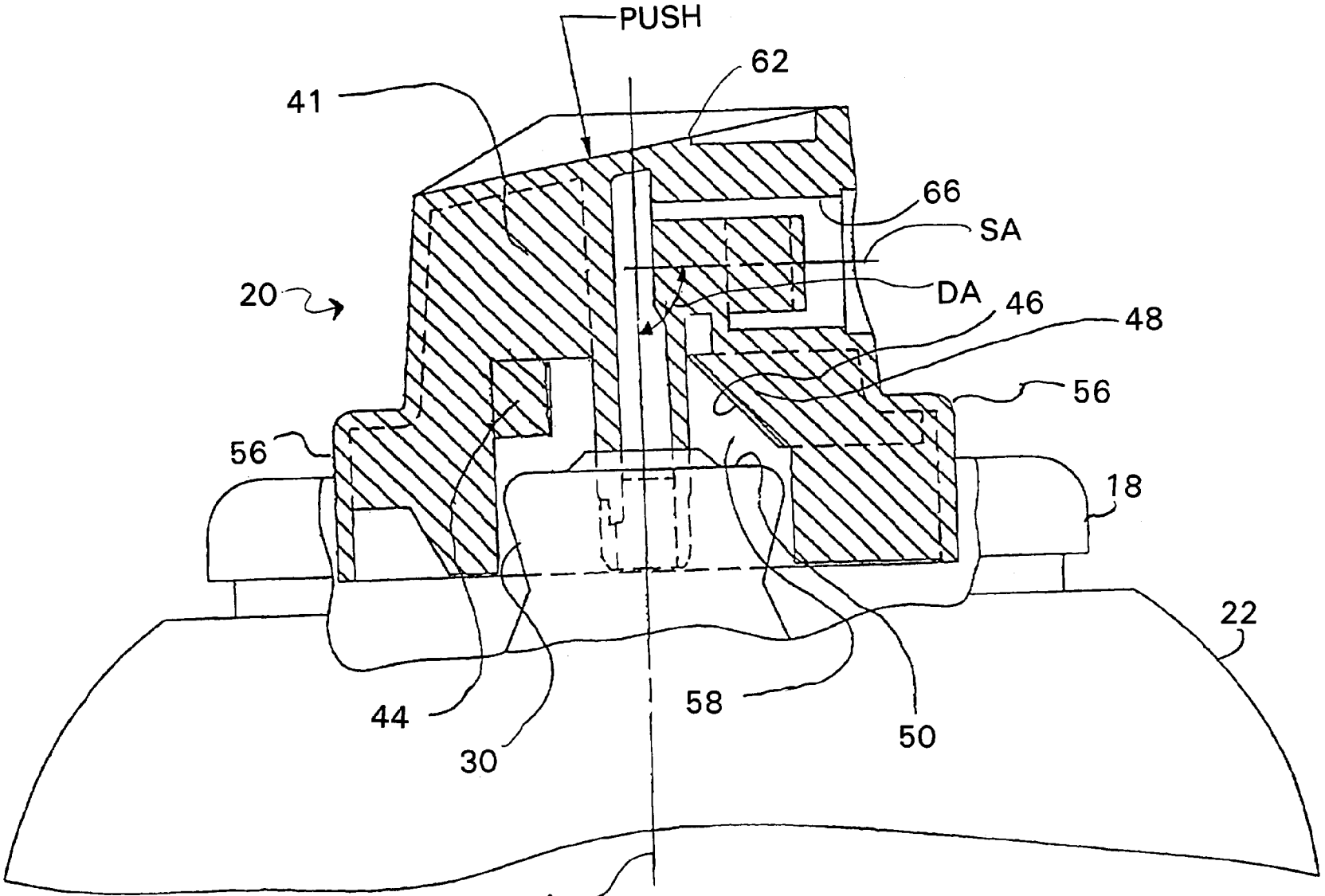
FIG. 4A is a diagrammatic illustration of an actuator, according to the present invention, in the unactuated position.
Figure 4B:
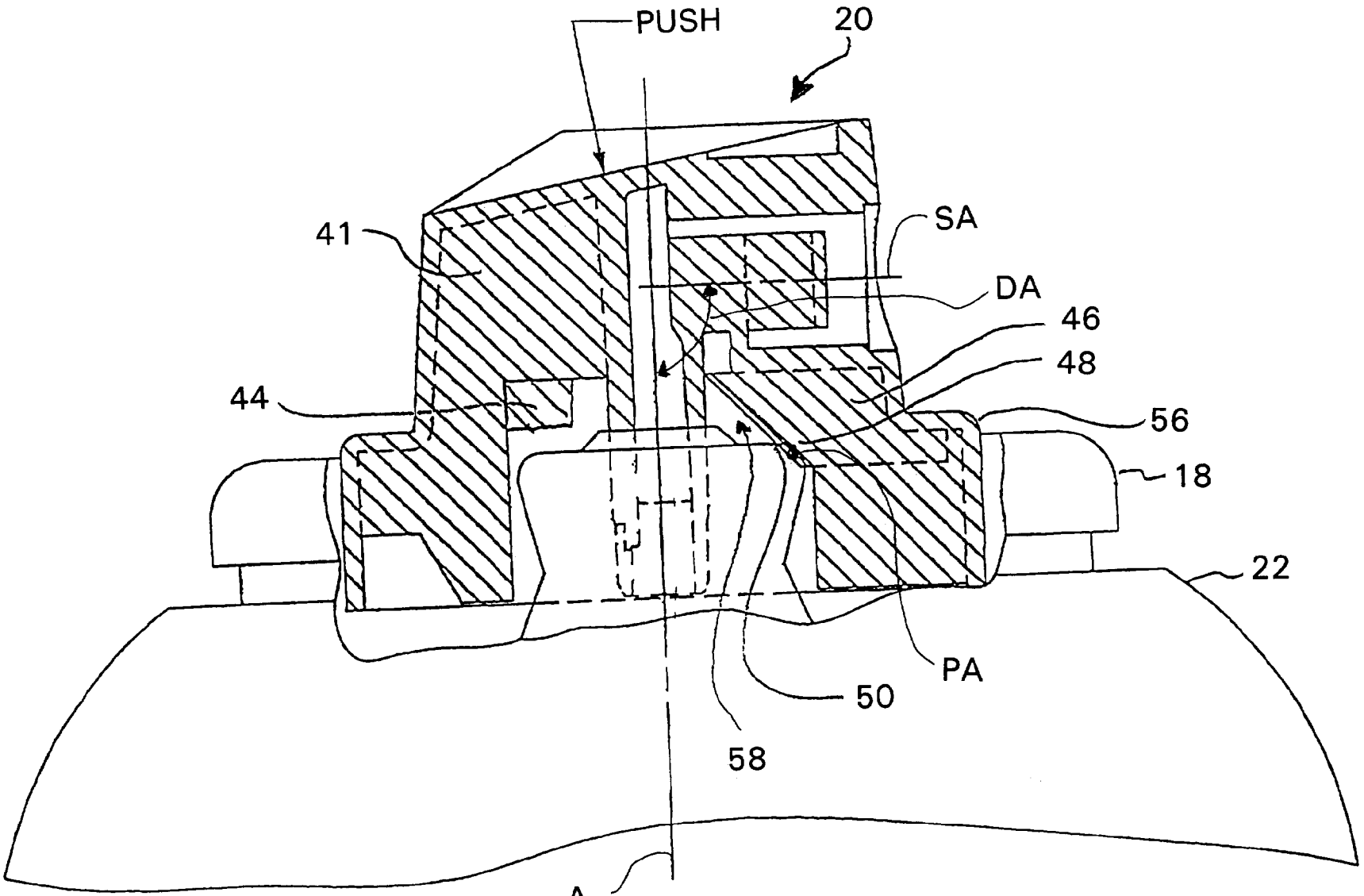
FIG. 4B are diagrammatic illustration of an actuator of the present invention in an intermediate actuated position.
Figure 4C:
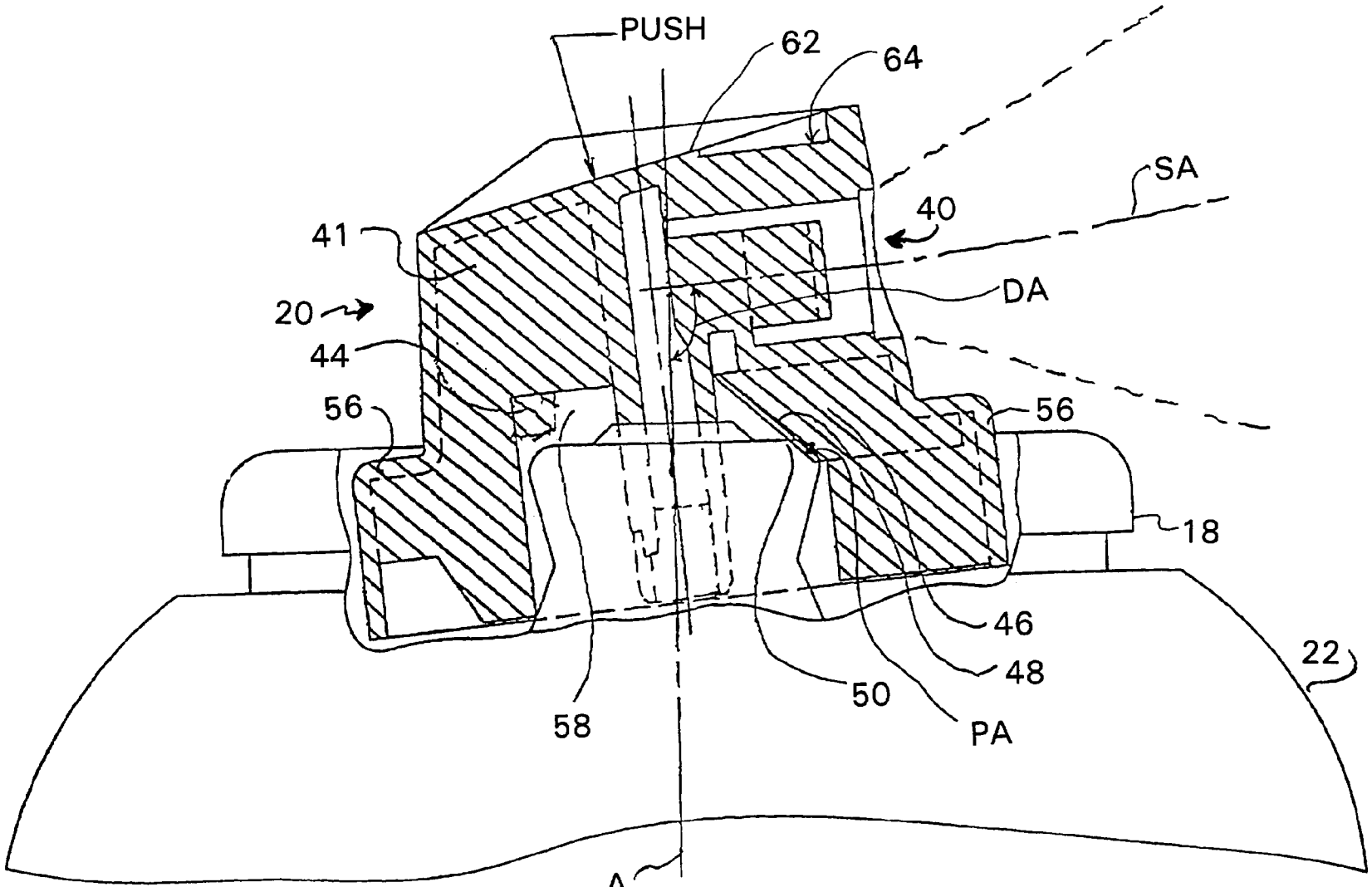
FIG. 4C is a diagrammatic illustration of an actuator, according to the present invention, in the fully actuated position.

One feature of the present invention is to avoid the above drawback associated with the prior art actuators. This feature is illustrated in FIGS. 4A, 4B and 4C, which show the actuator 20 of the present invention respectively shown in its unactuated position, its intermediate actuated position and its fully actuated position. As shown in FIGS. 4A, 4B and 4C, the actuator 20 of the present invention includes one or more deflector ribs 46. Each deflector rib 46 forms and acute angle, e.g., an angle of about 45 degrees or so, with the longitudinal axis A of the actuator 20. Each deflector rib 46 is attached to the lower surface of the actuator body 41 and extends both axially and radially into the recess 58. The deflector ribs 46 are generally located in a quadrant of the recess 58 supporting the insert cavity 66 with at least one deflector rib 46 being located adjacent to and extending generally parallel to the insert cavity 66. Each deflector rib 46 includes an abutment surface 48 that is located and dimensioned to abut with the upper surface 50 of the pedestal 30 just prior to the point where valve assembly 18 is actuated to allow flow of the product to be dispensed 16 through the valve assembly 18. The abutment between one or more deflector ribs 46 with the upper surface 50 will, upon further depression of the actuator 20, cause the actuator 20 to be pivoted or tilted "backward" slightly and adjust or modify the product discharge angle DA from the discharge outlet 40. That is, the product discharge angle DA formed between the dispensed product spray axis SA and the longitudinal axis A of the valve assembly 18 is increased by a few degrees, e.g., 10 degrees or so, upon further depression of the actuator 20 whereby the dispensed product spray axis is adjusted upward such that the dispensed product 16' does not impinge upon the pedestal 30 or the container 12.

As indicated in FIGS. 4A, 4B and 4C, the actuator 20 may also include one or more conventional stop ribs 44, which will be located in the quadrants not occupied by the deflector ribs 46 and which will operate to limit the depression of the actuator 20 in a conventional manner. The upwardly adjustment of the spray angle, following contact between the deflector ribs 46 and the upper surface 50, generally will continue to increase until the stop ribs 44 are located closely adjacent the top surface of the pedestal 30 but a space slightly therefrom. If, however, the actuator is excessively depressed, the stop ribs 44 will the upper surface 50 of the pedestal 30 and thereby prevent further depression of the actuator 20.

The deflector ribs 46 are shaped to engage with the upper surface 50 of the pedestal 30 each time the actuator 20 is depressed prior to the actuator opening the valve assembly 18. Once the deflector ribs 46, located in a quadrant of the recess 58 supporting the insert cavity 66, abut with the upper surface 50 of the pedestal 30, such contact prevents further depression of the portion of the actuator 20 supporting the insert cavity 66. A pivot axis PA or hinge is formed by the engagement between the deflector ribs 46 and the upper surface 50 of the pedestal 30 so that further depression of the actuator 20 only allows the portion of the actuator 20, opposed to the deflector ribs 46, to move toward the pedestal 30 and facilitate opening of the valve assembly 18. During such further depression of the valve assembly, the pivot axis PA or hinge is functioning to pivot or tilt backward the actuator 20 a sufficiently distance, prior to the valve assembly opening, so that the product discharge angle DA is adjusted whereby dispensed product 16' will not impinge upon the aerosol container. Once the deflector ribs 46 sufficiently pivot or tilt the actuator 20 backward, further depression of the valve assembly then opens the valve assembly to permit the flow of product to be dispensed through the valve assembly 18.

Typically between one and five, preferably three, deflector ribs 46 are formed in the recess 58 of the actuator 20. The deflector ribs 46 are located and spaced so as to provide a stable contact with the upper surface 50 of the pedestal 30 so that the actuator 20 will pivot substantially in a plane defined by the longitudinal axis A and the dispensed product spray axis, i.e., the pivot axis PA or hinge extends normal to that plane.

Figure 5:
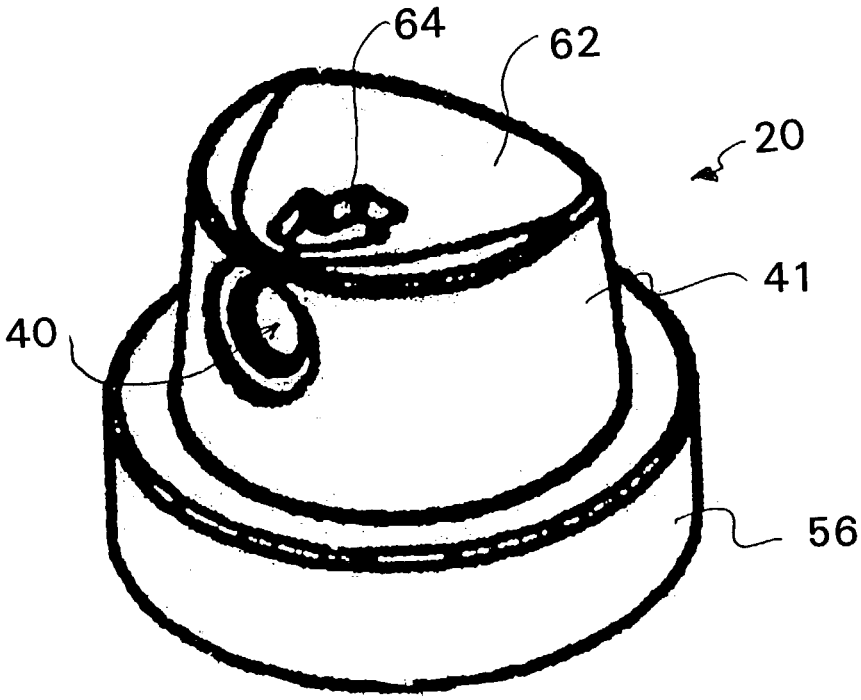
FIG. 5 is a front perspective view of the preferred embodiment of the actuator with stabilizing ribs according to the present invention.
Figure 5A:
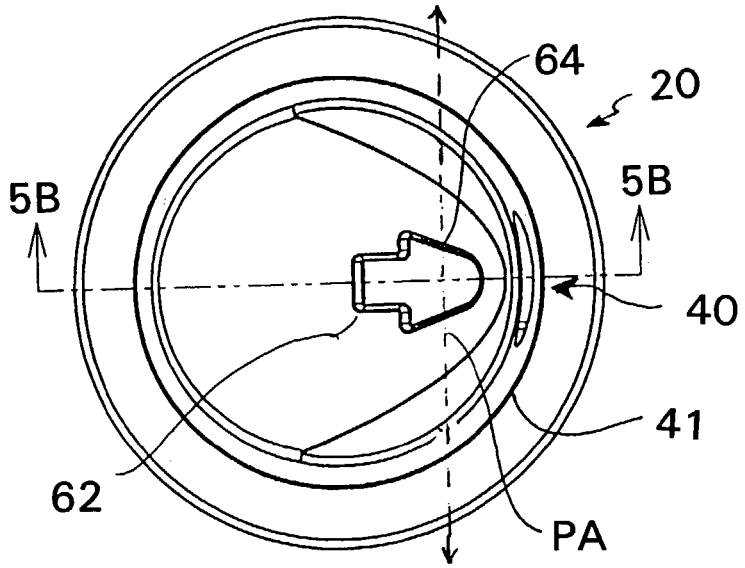
FIG. 5A is a top plan view of the actuator of FIG. 5.
Figure 5B:
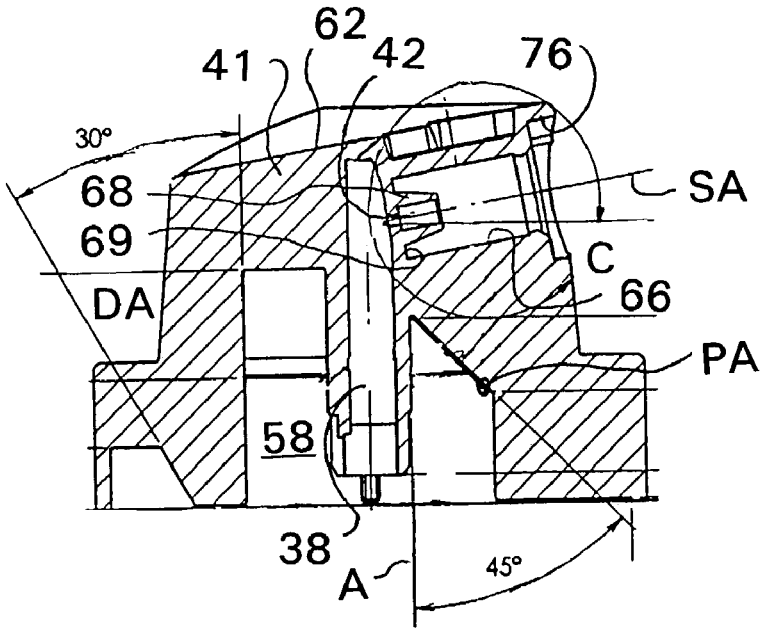
FIG. 5B is a cross-sectional view along section line 5B—5B of FIG. 5A.
Figure 5C:
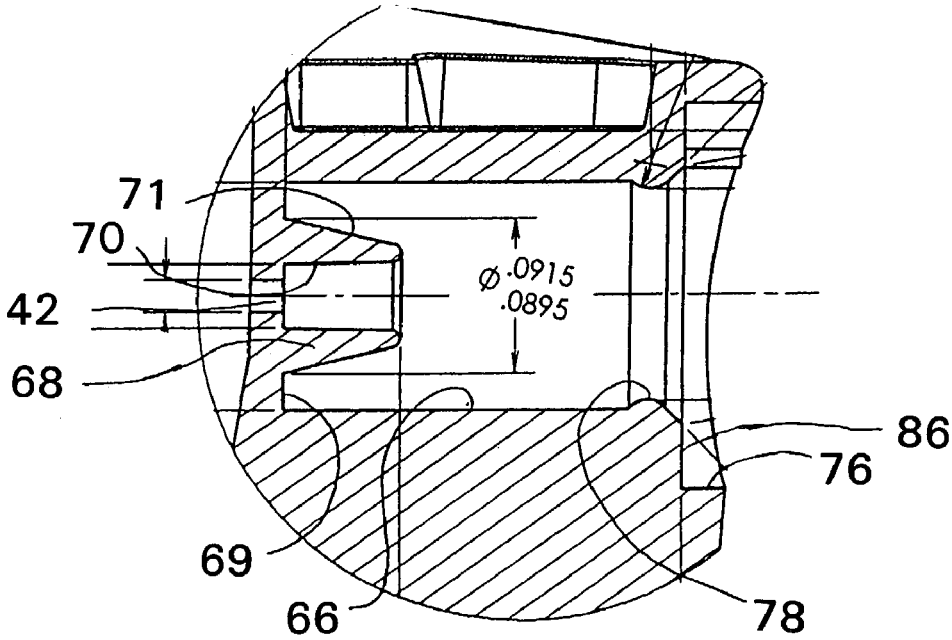
FIG. 5C is an enlarged sectional view of area C of FIG. 5B.
Figure 5D:
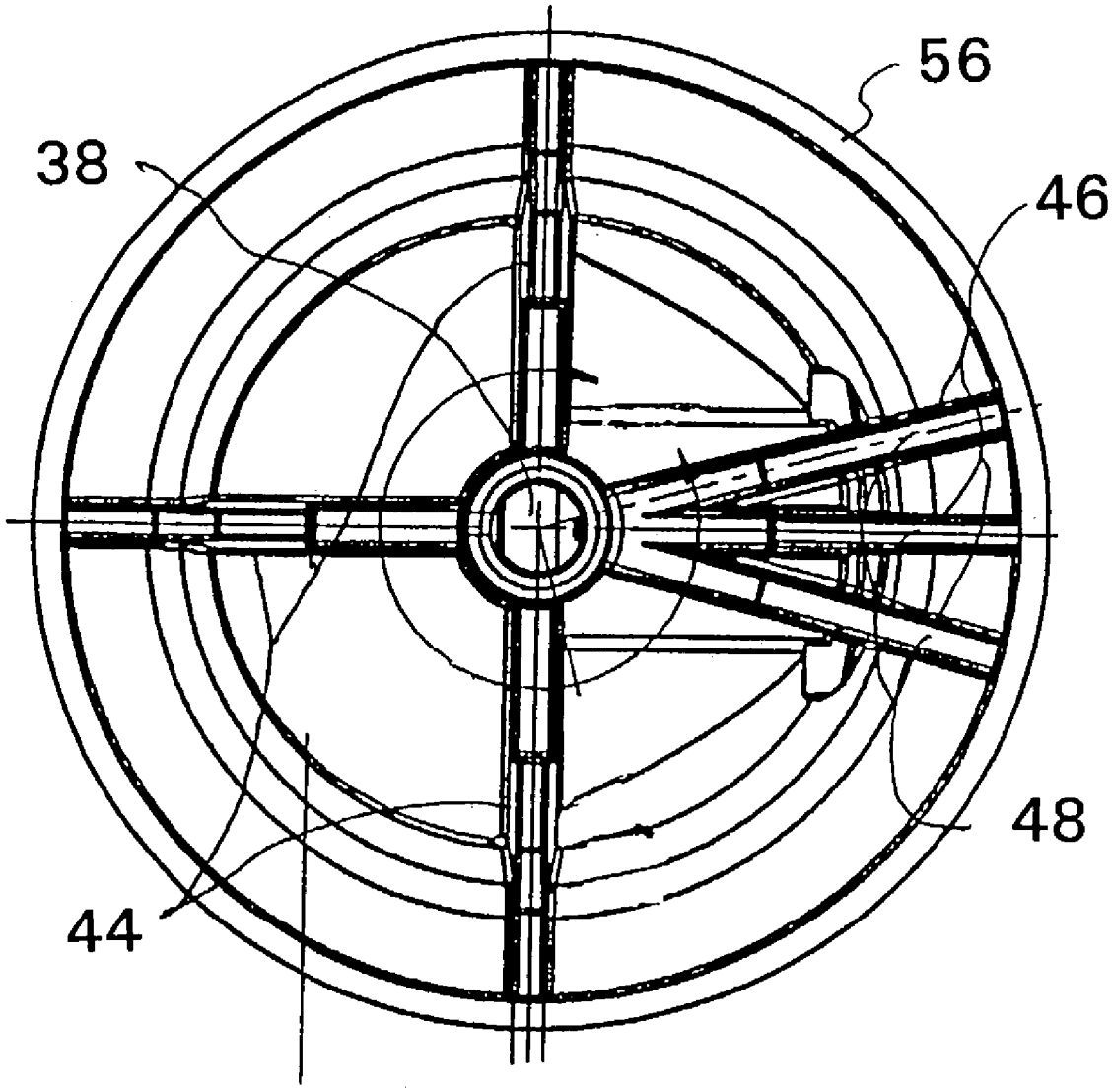
FIG. 5D is a bottom plan view of the actuator of FIG. 5 showing the deflector ribs.

With reference now FIGS. 5–6C, an improved fan spray insert 60 for use with the improved actuator 20, according to the present invention, will now be described. Turning first to FIGS. 5–5C, as with the previous embodiment, the improved actuator 20 includes an actuator body 41 and an actuator skirt 56 and has a central actuator passageway 38 which communicates with the discharge outlet 40 of the fan spray insert 60 via a radial actuator passageway 42. The actuator 20 also includes a finger recess area 62, on the top portion of the actuator 20, to facilitate the depressing of the actuator 20 by an operator. The finger recess area 62 typically has an arrow 64 formed therein which indicates to an operator the orientation of the fan spray insert 60 and the radial actuator passageway 42, i.e., the discharged direction of the fan spray from the actuator 20, upon depression thereof, to minimize the possibility of the operator inadvertently discharging the dispensed product 16' in the operator's face or some other undesired direction.

The actuator body 41 of the actuator 20 has an insert cavity 66 which accommodates the fan spray insert 60. The base 69 of the insert cavity 66 (see FIG. 5C) is provided with a conical shaped cavity hub 68 and the conical shaped cavity hub 68 generally has a substantially cylindrical inner wall 70 and a generally conical outer wall 71 which tapers from a wider dimension, adjacent the base 69, to a narrow dimension as the cavity hub 68 extends radially outward from the base 69 into the insert cavity 66. The cavity hub 68 typically has a height of about 0.07 inches or so and a diameter of about 0.0895 to about 0.0915. The cylindrical inner wall 70 partially defines the radial actuator passageway 42. The taper of the cavity hub 68 is generally between 20 degrees and 40 degrees, preferably about 30 degrees. The purpose and function of the taper of the cavity hub 68 will be discussed in further detail below with reference to the fan spray insert 60 of FIGS. 6–6C.

An interior wall of the actuator body 41, defining the insert cavity 66, is generally cylindrical in shape and extends radially outward from the base 69 of the insert cavity 66. A first locking member, such as an annular protrusion 78, is formed on the surface of the insert cavity 66 extends slightly radially inwardly therefrom to constrict slightly the diameter of the insert cavity 66. Preferably, the annular protrusion 78 is a curved surface which has a radius of curvature of about 0.015 of an inch or so and projects radially inwardly by a distance of about 0.01 of an inch or so. The annular protrusion 78 is located so as to matingly engage and permanently retain the fan spray insert 60 within the insert cavity 66 while allowing relative rotation of the fan shaped insert 60, i.e., allowing 360 degrees of rotation, and a further detailed description concerning such engagement will follow below.

The actuator radial passageway 42 and the discharge outlet 40 are both concentric with one another and define concentric longitudinal axes. The concentric longitudinal axes of actuator radial passageway 42 and the discharge outlet 40 both extend at an obtuse angle of about 100 degrees or so with respect to the longitudinal axis L of the actuator 20, the container 12 and the valve assembly 18. Such obtuse angle formed between the longitudinal axes of the actuator radial passageway 42 and the discharge outlet 40, on one hand, and the longitudinal axis L of the actuator 20, the container 12 and the valve assembly 18, on the other, further assists with minimizing the possibility of the dispensed product 16' being able to spray the top portion or rim of the aerosol container. A counterbore 76 is formed in the actuator body and the counterbore 76 is arranged concentric with the insert cavity 66. The counterbore 76 partially accommodates an insert head 72 of the fan spray insert 60 as will be discussed below in further detail.

Figure 6:
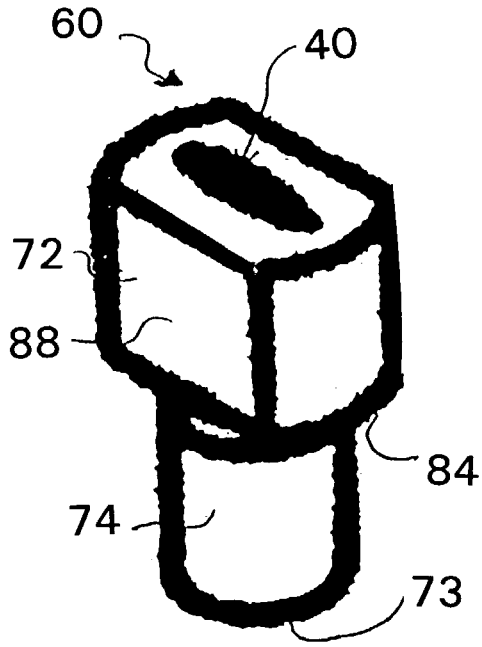
FIG. 6 is a front perspective view of the improved fan spray insert for use with the actuator of FIG. 5.
Figure 6A:
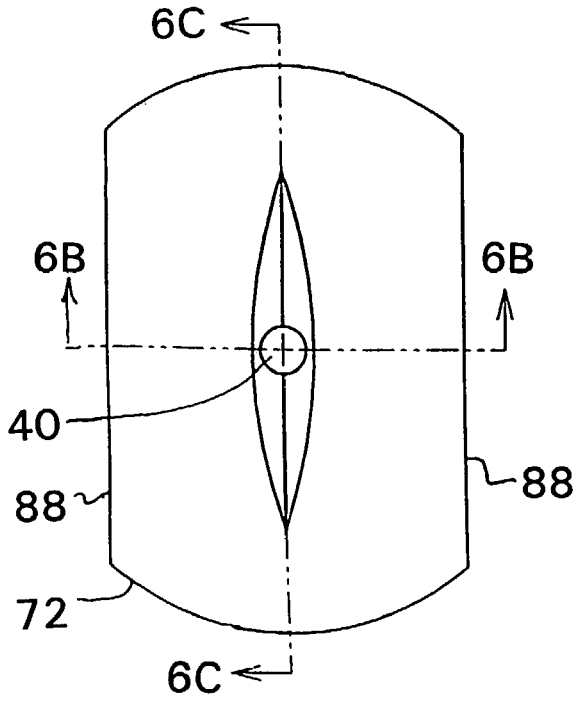
FIG. 6A is a top plan view of the improved fan spray insert of FIG. 6.
Figure 6B:
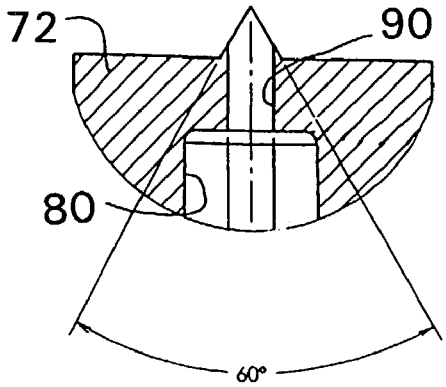
FIG. 6B is a partial cross-sectional view of the improved fan spray along section line 6B—6B of FIG. 6A.
Figure 6C:
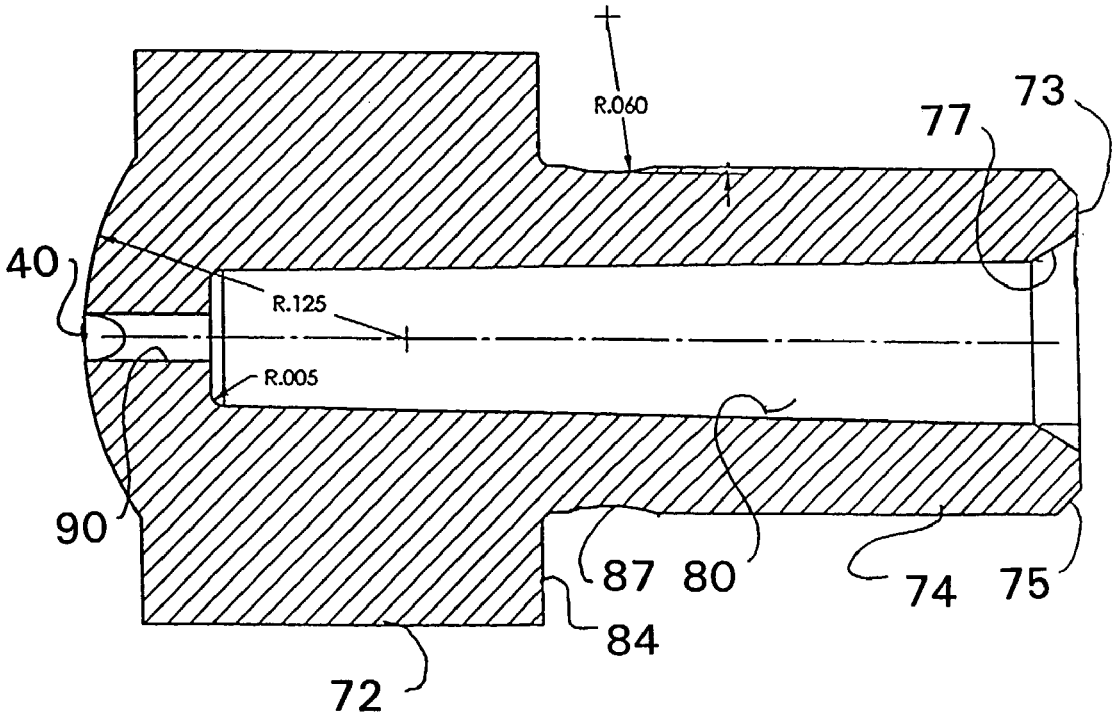
Figure 6D:
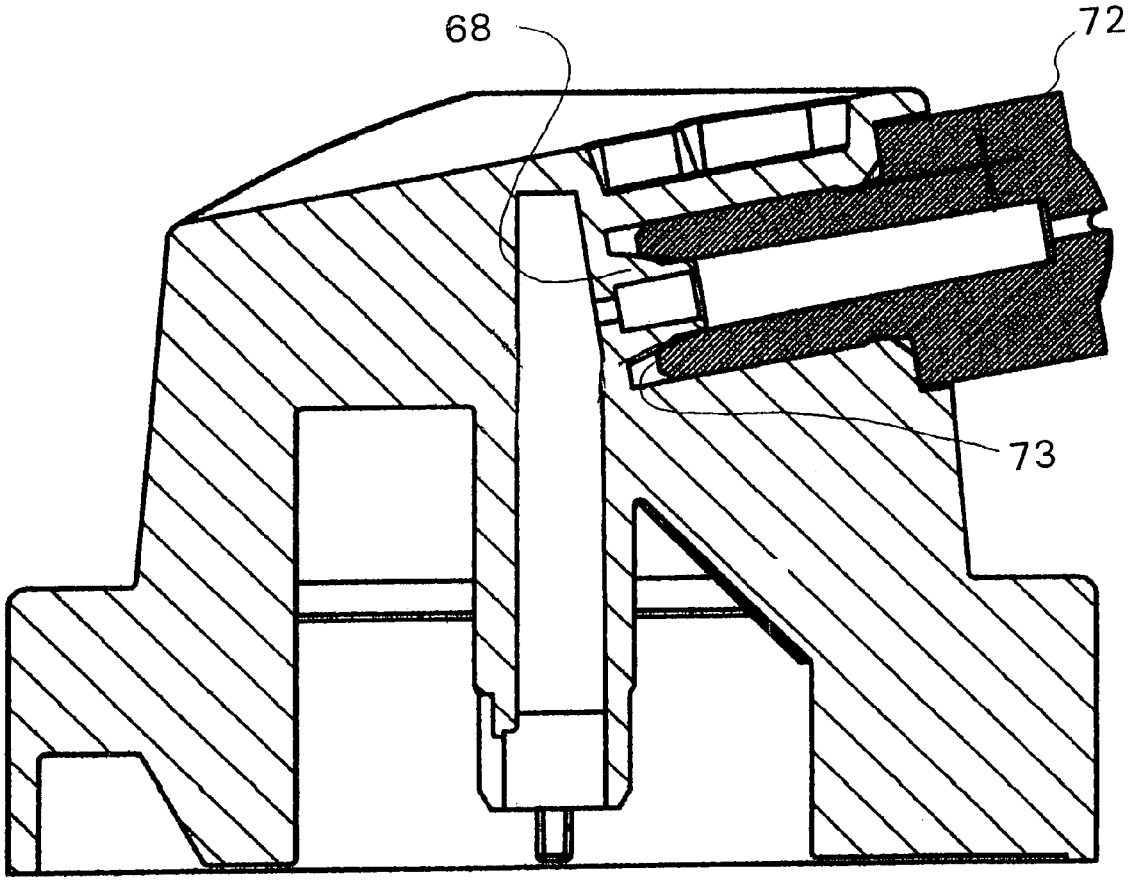
FIG. 6D is a cross-sectional view of the improved fan spray showing the insert leg of the fan spray engaged with the cavity hub.

With reference now to FIGS. 6–6C, a detailed description concerning the fan spray insert 60 will now be provided. The fan spray insert 60 generally comprises the enlarged insert head 72 and a narrower insert leg 74. The insert leg 74 is generally cylindrical in shape and a leading end 73 of the insert leg 74, remote from the insert head 72, has both an outer beveled or chamfered surface 75, e.g., chamfered at an angle of about 30–60 degrees and preferably about 45 degrees or so, as well as an inner beveled or chamfered surface 77, e.g., chamfered at an angle of about 15–45 degrees and preferably about 30 degrees or so. The outer chamfered surface 75 facilitates insertion of the insert leg 74 within the insert cavity 66 of the actuator 20 while the inner chamfered surface 77 facilitates mating engagement of the insert leg 74 with the cavity hub 68 supported by the base 69 of the insert cavity 66.

A central insert passageway 80 is formed within the fan spray insert 60 and this insert passageway 80 has a slightly larger cross sectional area or dimension, adjacent the leading end 73 of the insert leg 74 which tapers to a smaller cross sectional area or dimension adjacent the insert head 72. The cross sectional area or dimension of the insert passageway 80, adjacent the leading end 73 of the insert leg 74, is sized to readily receive a leading portion of the cavity hub 68 and, once a sufficient insertion force between the fan spray insert 60 and the actuator 20 is provided, the inner chamfered surface 77 of the leading end 73 of the insert leg 74 will dig or bite into and form an annular indentation in the exterior surface of the cavity hub 68 and provide a fluid tight engagement between those two components. Once the fan spray insert 60 is fully received within the insert cavity 66, a stop surface 84 of the insert head 72 abuts against a stop surface 86 of the counterbore 76 to prevent further insertion and prevent over-insertion of the fan spray insert 60 into the insert cavity 66.

To retain the engagement between the fan spray insert 60 and the insert cavity 66, a second mating locking member, such as an annular recess 87, is provided on or in the fan spray insert 60 and the annular recess 87 is sized to matingly engage with the annular protrusion 78 of the insert cavity 66. The annular recess 87 is located so as to engage with the annular protrusion 78, and retain the fan spray insert 60 in its installed position within the insert cavity 66, only once the leading end 73 of the insert leg 74 sufficiently engages with the cavity hub 68 of the insert cavity 66 and provides a fluid tight sealingly engagement.

The insert head 72 is sized to be slightly smaller in dimension than a diameter of the counterbore 76 formed in the actuator 20 to allow the insert head 72 to be readily received within the counterbore 76 and, once installed within insert cavity 66 of the actuator 20, be rotated 360 degrees therein. This arrangement allows the operator to rotate or adjust the discharge orientation of the fan spray, produced by the fan spray insert 60, relative to when it is utilized to discharge the dispensed product 16' from the aerosol container. To facilitate rotation or adjustment of the orientation of the fan spray discharge, the insert head 72 is provided with a pair of opposed, flat, parallel, surfaces 88 which form a knob or grip and facilitate easy grasping or pinching of the insert head 72 of the fan spray insert 60, by a pair of fingers of the operator, to allow rotation of the fan spray insert 60 within the insert cavity 66 to a desired orientation so that the spray discharge from the fan spray insert 60 can be easily oriented, as required by the operator, for a particular spray application.

The product to be dispensed 16, as its flows through the central insert passageway 80 toward the discharge orifice 40 of the fan spray insert 60, is constricted, by constriction orifice 90, prior to being discharged via the discharge orifice 40. As the product to be dispensed 16 is discharged by the discharge orifice 40, the spray is allowed to expand and fan out or disperse into an acuate spray pattern, e.g., an acuate fan spray discharge pattern. The acuate fan spray discharge pattern of the dispensed product 16' lies substantially in a plane and has a discharge angle of between approximately 15 to 90 degrees, more preferably a discharge angle of approximately 30 degrees or so. As the remaining features of the fan spray discharge orifice 40 of the fan spray insert 60 are conventional and well known in the art, a further detailed discussion concerning the same is not provided.

It is desirable, but not required, for the tapered angle of the conical outer wall 71 of the hub 68 to be less than the tapered angle of the inner beveled or chamfered surface 77 of the insert head 72, e.g., smaller by about 0 to about 17 degrees or so. This arrangement initially causes a point contact between the hub and the insert head, once the insert head 72 engages with the hub 68. Thereafter, further engagement between the insert member and the hub deforms the conical outer wall 71 of the hub 68 inward, by a depth of about 0.005 inches or so, and causes the conical outer wall 71 of the hub 68 to mate and closely conform with the inner beveled or chamfered surface 77 of the insert head 72 due to compression of the hub 68. Such deformation and compression provides a fluid tight seal between the insert member and the hub to prevent any "blow by" or "blow back" past the formed fluid tight seal.

Preferably the fan spray insert 60 is made of a relatively "hard" material, such as acetyl, polyester or nylon having a density of about 1.0 to 1.4, for example, while at least the cavity hub 68 of the actuator is manufactured of a relatively "soft" material, such as polypropylene or polyethylene having a density of about 0.9, for example. Due to such arrangement, when the insert leg 74 of the fan spray insert 60 receives and engages with the cavity hub 68 of the actuator 20, the fan spray insert 60 bites into and partially deforms the exterior surface of the cavity hub 68, i.e., the forms an annular groove or indentation in the exterior surface of the cavity hub 68. Such engagement results in an overlapped arrangement, between the fan spray insert 60 and the cavity hub 68, and provides a fluid tight seal between those two components so as to minimize the possibility of any fluid, i.e., the product contents and/or the aerosol product, leaking therebetween and enter into the insert cavity 66. It is also possible for the cavity hub 68 of the actuator 20 to receive the insert leg 74 of the fan spray insert 60 such that the cavity hub 68 overlaps the insert leg 74, but the seal formed by such engagement may be more prone to leak and allow the product to be dispensed 16 and/or the aerosol product to flow between those two components and enter into the insert cavity 66.

An important aspect of the present invention is that the leading end of the cavity hub 68 at least partially extends into the central insert passageway 80 of the fan spray insert 60 and is received therein to provide an overlapped seal between the cavity hub 68 and the leading edge of the insert leg 74 of the fan spray insert 60. Due to this overlapped arrangement, it is less likely that any of the product contents will have a tendency to leak between the seal formed between the cavity hub 68 and the overlapped insert leg 74 of the fan spray insert 60.

Another important feature of the present invention is that the fan spray insert 60 be permanently retained within the insert cavity 66 while still allowing the fan spray insert 60 be rotated relative to the actuator 20 to facilitate adjustment or modification of the discharge from the fan spray insert. Accordingly, it is to be appreciated that other mating locking members, carried by the fan spray insert 60 and the insert cavity 66, respectively, could be utilized for permanently retaining the fan spray insert 60 therein while still allowing relative adjustment or rotation between those two components. For example, the insert cavity 66 could carry the annular groove while the fan spray insert 60 could carry the annular protrusion. Alternatively, a variety of other conventional and well known mating locking members could be utilized on the fan spray insert 60 and the insert cavity 66 to facilitate an adjustable locking engagement between those two components.

In conclusion, while the invention has been particularly shown and described with reference to preferred embodiments of the apparatus and methods thereof, it will be also understood by those of ordinary skill in the art that various changes, variations and modifications in form, details and implementation may be made therein without departing from the spirit and scope of the invention as defined by the appended claims. Therefore, it is the object of the appended claims to cover all such variation and modifications of the invention as come within the true spirit and scope of the invention.

What is claimed is:

1. An actuator for attachment to a valve assembly of an aerosol container, the actuator comprising:

an actuator body having an actuator skirt defining a recess sized to receive a portion of a pedestal of a mounting cup of the valve assembly during depression of the actuator, and the actuator having an actuator passageway facilitating fluid communicating between a valve stem, of the valve assembly, and an insert cavity of the actuator;

a fan spray insert received within the insert cavity, and the fan spray insert having a fan spray discharge orifice communicating with an insert passageway of the fan spray insert for discharging product from the actuator;

the fan spray insert having a first mating locking member and the insert cavity having a second mating locking member, and the first and second mating locking members engage with one another, when the fan spray insert is received within the insert cavity, to form a permanent secondary seal therebetween and permanently retain the fan spray insert within the insert cavity while also allow relative rotation of the fan spray insert with respect to the insert cavity to adjust an orientation of the spray discharge pattern during use of the actuator;

the fan spray insert has an insert head which extends out of the insert cavity, following insertion of the fan spray insert within the insert cavity, and provides a grip which facilitates rotation of the fan spray insert within the insert cavity to a desired spray orientation by an operator;

the insert cavity has a cavity hub supported by a base of the insert cavity, the cavity hub has an internal passageway extending therethrough which facilitates fluid communicating between the actuator passageway of the actuator body and the insert passageway of the fan spray insert, and the cavity hub engages with a leading end of the fan spray insert to form permanent primary fluid tight seal therewith, preventing the passage of fluid past the primary fluid tight seal once the fan spray insert is received within the insert cavity; and the internal passageway of the cavity hub has a cylindrical inner wall and the cavity hub has a generally conical outer wall which tapers from a wider dimension to a narrow dimension as the cavity hub extends radially outward from the base of the insert cavity, the actuator passageway includes a radial actuator passageway extending through the cavity hub, and a counterbore is formed in the actuator body concentric with the insert cavity.

2. The actuator according to claim 1, wherein the cavity hub and the leading end of the fan spray engage one another in an over lapped manner to form the permanent primary fluid tight seal and minimize leakage therebetween.

3. The actuator according to claim 1, wherein the insert head of the fan spray insert has a larger dimension than a smaller dimension insert leg and a leading end of the insert leg has both an outer chamfered surface and an inner chamfered surface, and the outer chamfered surface facilitates insertion of the insert leg within the insert cavity while the inner chamfered surface facilitates mating engagement between the insert leg and the cavity hub.

4. The actuator according to claim 1, wherein the insert cavity Is cylindrical and extends radially outward from the base of the insert cavity, and the cylindrical wall of the insert cavity supports the first locking member.

5. The actuator according to claim 4, wherein the first locking member is an annular protrusion formed in the cylindrical wall of the insert cavity, and the annular protrusion extends radially inwardly to constrict slightly a diameter of the insert cavity; and the second mating locking member is an annular recess formed in an outwardly facing surface of the fan spray insert, and the annular recess receives the annular protrusion to retain the fan spray insert within the insert cavity.

6. The actuator according to claim 5, wherein the annular protrusion is a curved surface which has a radius of curvature of about 0.015 of an inch and projects radially inwardly by a distance of about 0.01 of an inch.

7. The actuator according to claim 1 in combination with a valve assembly, wherein the actuator is attached to and supported by a stem of the valve assembly, via the actuator passageway, and the discharge outlet of the fan spray insert defines an insert longitudinal axis, and the valve assembly defines a valve assembly longitudinal axis, and the insert longitudinal axis forms an obtuse angle of at least 100 degrees with respect to the valve assembly longitudinal axis to minimize the product to be dispensed from spraying a top portion of an aerosol container.

8. The actuator according to claim 1, wherein the insert passageway extends along an entire length of an insert leg and the insert passageway of the insert leg receives, overlaps and deforms the cavity hub and forms the permanent primary fluid tight seal therebetween.

9. The actuator according to claim 1 wherein the insert head is received within the counterbore formed in the actuator, and the insert head abuts against a surface of the actuator body to prevent further insertion of the fan spray insert within the counterbore, and the insert head is provided with a pair of opposed flat surface which facilitate grasping of the insert head by the operator to allow adjustment of the spray discharge pattern of the fan spray insert.

10. The actuator according to claim 1, wherein the fan spray insert is manufactured from a first material and at least the cavity hub is manufactured from a second material which is softer than the first material so that the fan spray insert partially deforms the cavity hub when the fan spray insert engages therewith.

11. The actuator according to claim 10, wherein the first material is selected from the group comprising acetyl, polyester and nylon and the second material is selected from the group comprising polypropylene and polyethylene.

12. The actuator according to claim 1 in combination with a valve assembly having a mounting cup, wherein the actuator is attached to and supported by a stem of the valve assembly, via the actuator passageway, adjacent the mounting cup and the actuator has at least one deflector rib located to engage with a pedestal of the mounting cup each time the actuator is depressed, the at least one deflectar rib engages with the pedestal, prior to the actuator opening the valve assembly, to tilt the actuator backward a sufficient distance whereby dispensed product from the insert will not impinge against the aerosol container.

13. The actuator according to claim 12, wherein the at least one deflector rib pivots the actuator backward by about 10 degrees so as to adjust a product discharge angle from the discharge outlet.

14. The actuator according to claim 1, wherein the actuator has at least one stop rib located to abut against a pedestal and limit depression of the actuator so as to prevent excessive depression of the actuator.

15. The actuator according to claim 1, wherein a chamfered surface of the fan spray insert forms a contact with the hub, once the fan spray insert engages with the hub, and further engagement between the fan spray insert and the hub partially deforms a conical outer wall of the hub so that the outer wall of the hub conforms to the chamfered surface of the fan spray insert and forms the primary fluid tight seal between the fan spray insert and the hub while the first and second mating locking members engage with one another and form the secondary seal between the fan spray insert and the actuator.

16. The actuator according to claim 1, wherein the first mating locking member is an annular recess provided in the fan spray insert and the second mating locking member is an annular protrusion provided within the insert cavity, and the annular recess matingly engages with the annular protrusion of the insert cavity and forms the permanent secondary seal therebetween.

17. The actuator according to claim 1, wherein cylindrical inner wall of the internal passageway forms a product flow path through the hub to the fan spray insert.

* * * * *